US005952622A

United States Patent [19]

LePoutre

[11] Patent Number: 5,952,622

[45] Date of Patent: Sep. 14, 1999

[54] SOUND SUPPRESSING DEVICE FOR INSTALLATION INSIDE AN INTERNAL COMBUSTION ENGINE'S AIR FILTER BOX

[76] Inventor: Edmond Pol Jean LePoutre, Rua David Abraao, No. 133, Parque Bariqui, Curitiba, Brazil

[21] Appl. No.: 08/881,619

[22] Filed: Jun. 24, 1997

[51] Int. Cl.[6] ..... F02M 35/00

[52] U.S. Cl. ..... 181/229; 55/DIG. 30; 123/198 E

[58] Field of Search ..... 181/224, 225, 181/229, 230, 200, 204, 202; 55/276, DIG. 30; 123/198 E

[56] References Cited

U.S. PATENT DOCUMENTS 4,483,413 11/1984 Ohashi ..... 181/224
4,619,344 10/1986 Uesugi et al. ..... 181/229
4,733,750 3/1988 Poirier et al. ..... 181/202
5,467,747 11/1995 Brandt et al. ..... 181/204
5,649,986 7/1997 Mueller ..... 123/198 E

*Primary Examiner*—Khanh Dang
*Attorney, Agent, or Firm*—Hughes Hubbard & Reed LLP; Ronald Abramson; Peter A. Sullivan

[57] ABSTRACT

A moldable acoustic device is internally coupled to a vehicle engine's air filter. The moldable acoustic device has the shape of a circular box or of any other shape, and includes a plate of acoustic absorbing material provided with porosities or a set of plates of acoustic materials provided with porosities, superimposed and glued to each other, having its shape predetermined pursuant to the internal and acoustic characteristics of the conventional air filter to which it will be internally coupled. The moldable acoustic device is essentially an acoustic internal lining for the purpose of absorbing acoustic waves generated by engine inlet noises, that is coupled by gluing or otherwise inside the air filter's upper compartment and/or lower compartment. The moldable acoustic device is also removable or not from the compartments.

7 Claims, 2 Drawing Sheets

SOUND SUPPRESSING DEVICE FOR INSTALLATION INSIDE AN INTERNAL COMBUSTION ENGINE'S AIR FILTER BOX

FIELD OF THE INVENTION

The present invention relates to a moldable, acoustic tubular device made of sound-absorbing material or a set of sound-absorbing materials, which has the shape thereof predetermined according to the internal characteristics of, and being coupled inside of a conventional air filter of an automobile, pick-up truck, truck or other vehicle.

BACKGROUND OF THE INVENTION

As is known in the automotive industry, there are at present acoustic devices located in the inner part of a vehicle engine's air filter, which can be, for example, the known sound-reducers or truncated-cone sound reducers, made of plastic or metal, which are generally coupled around circular openings (1-A1, 2A1)—see FIG. 1 annexed hereto, showing a lateral cross-section of a type of conventional air filter (10) located and made respectively on one side of the air filter's upper compartment (1) and lower compartment (2), the air filter element (3) remaining pressed between the two compartments (1, 2) and the internal supports for the air filter element (3).

In accordance with FIG. 1, the air is aspirated by the dirty air inlet nozzle (1-A) of the upper compartment (1) and in the aspiration sequence—indicated by trajectory indicated by the larger arrows (S-1)—the air passes through the noise reducer or truncated cone shaped sonorizer, (not shown in FIG. 1), coupled around the circular opening (1-A1). The air then enters the upper compartment (1), then passes through the filtering element (3), enters the lower compartment (2) of the air filter (10) and passes through the noise reducer or truncated cone shaped sonorizer of the lower compartment (2) that is coupled around the circular opening (2-A1), entering the purified air exit nozzle (2-A) and then into the vehicle's engine, whereby, simultaneously and inversely to the trajectory described above and indicated by larger arrows (S-1), there is a sequence of inlet noises by means of sound waves. These sound waves are shown sequentially by bold arrows (S-2), which finally exit through the dirty air inlet nozzle (1-A) of the upper compartment (1) of the air filter (10).

However, these prior art internal noise reducers or truncated cone shaped sonorizers are integral parts usually made of plastic or also metal. These materials are non-acoustical and are rather noise propagators. The reducers or sonorizers allow by reason of their truncated cone shape only a modest dampening of the inlet noises—by breaking up the sound waves—and that include the engine's and air aspiration noises, exiting through the dirty air inlet nozzle (1-A).

The current technology also includes the known external acoustical tubes or boxes that control the engine's air inlet and that are arranged upstream of the air filter—being coupled to the dirty air inlet nozzle (1-A) of the upper compartment (1) of air filter (10); but even with the use of these external, acoustic tubes or boxes, the internal noise reducers or truncated cone shaped sonorizers, by reason of being made of plastic or metal, effectively do not cause the desirable technical effect of noise reduction, because they do not absorb the acoustical waves. It is finally noted that the addition of these prior art tubes or boxes contributes to increase the costs of this technique, in addition to taking up much room in the engine's compartment.

OBJECTS OF THE INVENTION

The moldable acoustic device which is the subject matter of the present invention has been conceived and designed to solve the aforementioned deficiencies of the state of the prior art.

SUMMARY OF THE INVENTION

In keeping with these objects and others which may become apparent, the present invention includes a moldable acoustic device which includes an acoustic internal lining that can assume several shapes—compatible with the internal and acoustic shapes of the conventional air filter to which it will be internally coupled by gluing or otherwise. The moldable acoustic device is therefore a stamped or thermoformed part, removable or not, that can be coupled inside either of the conventional air filter's upper compartment or lower compartment.

DESCRIPTION OF THE DRAWINGS

The present invention can best be understood in conjunction with the accompanying drawings, in which.

DETAILED DESCRIPTION OF THE DRAWINGS

Figure 1:
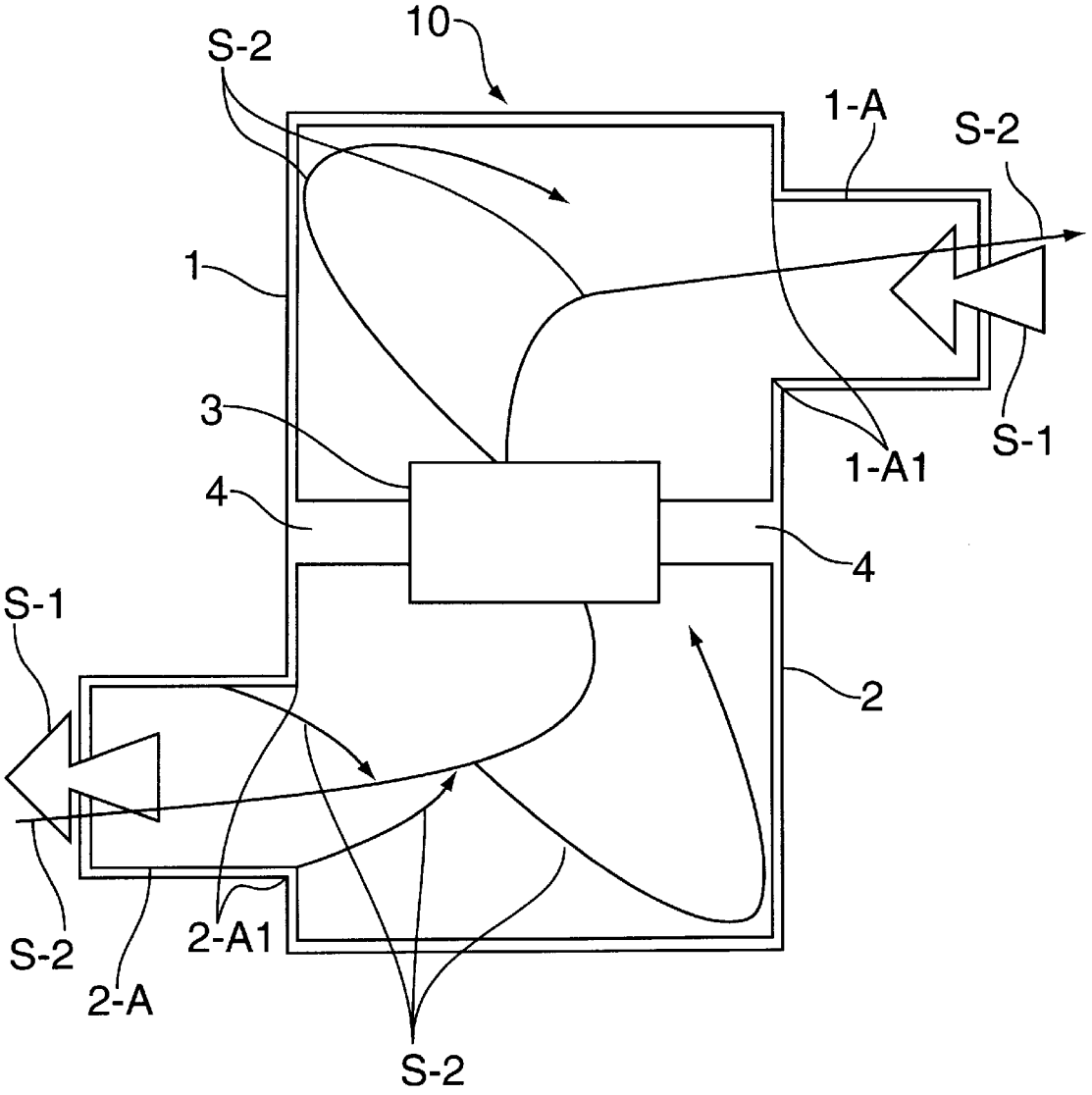
FIG. 1 PRIOR ART
FIG. 1 is a cross sectional view of a prior art air filter.
Figure 2:
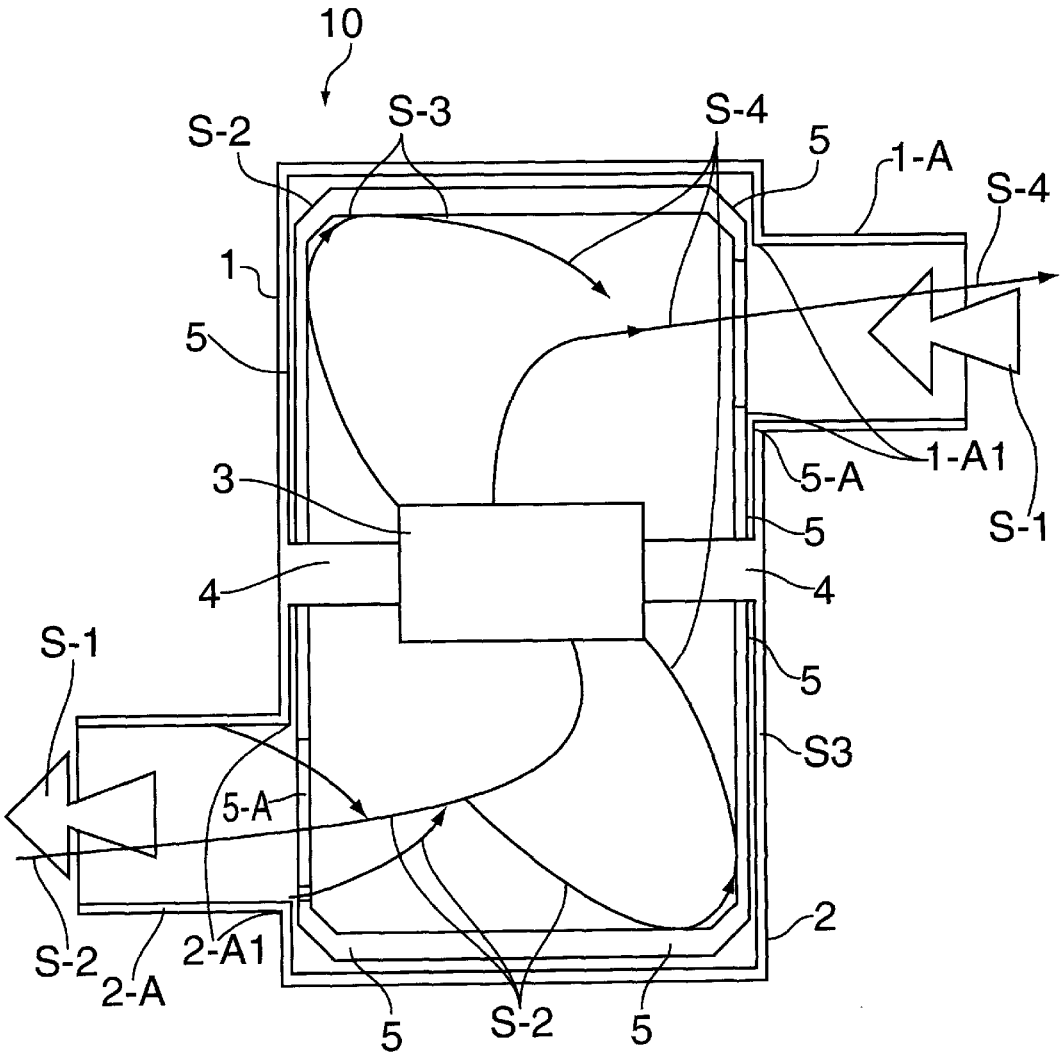
FIG. 2 is a cross sectional view of an air filter having the moldable acoustic device of the present invention.

The present invention can be better understood by examining FIG. 2, which shows a lateral cross-section of a conventional air filter (10) provided with an upper compartment (1) having a dirty air nozzle (1-A) and a circular opening (1-A1) made on the wall of compartment (1). The air filter element (3) is pressed between the filter's upper (1) and lower (2) compartments and the internal supports (4) of the air filter element. There is also a second circular opening (2-A1) made on the wall of compartment (2), which is followed by a purified air exit nozzle (2-A) towards the inside of the vehicle's engine.

As shown in FIG. 2, the moldable acoustic device (5) of the present invention forms a box of a circular or any other shape, that is coupled by gluing or otherwise to the inner surfaces of the air filter's upper compartment (1), with a circular lateral opening (5-A) coinciding with the circular lateral opening (1-A1) of the upper compartment (1), and also coinciding with the circular lateral opening (2-A1) of the lower compartment (2), the device (5) being open in the direction of positioning with the air filter element (3) of air filter (10).

Accordingly, the moldable acoustic device (5) is moldable in the shape of a box of a circular or any other shape, that internally lines the upper (1) and lower (2) compartments of air filter (10), or may line only one of these two compartments (1 or 2).

It should be noted that the moldable acoustic device (5), which is in the shape of a box, or a circular or any other shape, is made of an acoustic absorbing material provided with porosities or made of a set of acoustic materials, all of which acoustics materials have porosities.

By way of example, in the case where only one acoustic absorbing material is employed in the manufacture of the moldable acoustic device (5), this acoustic material can be a non-woven, porous and treated polyester plate. Also by way of example, in the case where a set of acoustic materials is employed in the manufacture of the moldable acoustic device (5), this set of materials can include superimposed porous substrates, such as sheets or plates adhered or glued to each other, made of porous paper, perforated aluminum and cotton tissue.

For manufacture of the moldable acoustic device (5) there is employed a mold, a thermo-pressing machine or another appropriate manufacturing process. It should be emphasized that for each type of conventional filter a study of its acoustic characteristics is made in order to allow the proper molding of the acoustic, box-shaped device (5) applicable thereto.

The beneficial technical effect caused by the moldable acoustic device (5) of a circular or any other shape is that of absorbing sound waves coming through exit nozzle (2A) of air filter (10). It is noted that in experiments made, the moldable acoustic device (5) which is the subject matter of the present invention, has shown a significant decibel gain with respect to the conventional noise reducers or truncated cone shaped sonorizers made of plastic or metal, and the aforementioned prior art acoustic external tubes or boxes previously mentioned.

The absorption of sound waves by the moldable acoustic device (5) is shown in FIG. 2, whereby the sound waves, indicated by the sequence of bold arrows (S-2) coming from the vehicle's engine through the purified air exit nozzle (2-A), enter the lower compartment (2) of air filter (10) and are initially absorbed by the moldable acoustic device (5). As shown by the small sinuous arrow (S-3), the sound waves, which are already partially absorbed, pass to the upper compartment (1) through the air filter element (3), and in the upper compartment (1) are again absorbed by moldable acoustic device (5), as shown by the small sinuous arrow (S-3). Subsequently the sound waves, with a significant decrease in intensity, as shown by arrows (S-4), exit through the dirty air inlet nozzle (1-A).

It is further noted that other modifications may be made to the present invention in accordance with the scope of the present invention, as noted in the appended claims.

I claim:

1. A sound absorbing assembly for attenuating the noise of an internal combustion engine, said sound absorbing assembly comprising:

air filtering means for filtering a clean air flow of the air intake and flowing along a path toward the internal combustion engine, said filtering means comprising:

a housing formed with an inner peripheral surface, an upstream compartment that is provided with an air intake nozzle receiving the air intake, a downstream compartment being in flow communication with the upstream compartment and receiving the clean air flow, a filtering element between said upstream and downstream compartments, said downstream compartment being provided with an outlet clean air nozzle, and a sound absorbing device including at least one layer of a porous sound absorbing material, molded so as to intimately fit to the internal shape of said internal peripheral surface.

2. The assembly defined in claim 1 wherein the porous sound absorbing material includes another layer superimposed with and operatively attached to the one layer.

3. The assembly defined in claim 1 wherein the sound absorbing assembly further includes:

a first passage in said upstream chamber of the housing and terminating downstream from the air intake nozzle, said first passage coinciding with the air intake nozzle, and a second passage terminating upstream from the outlet clean nozzle in said downstream chamber and coinciding with the outlet clean nozzle.

4. The assembly defined in claim 1 wherein said sound absorbing device is mounted in at least one of said upstream and downstream chambers.

5. The assembly defined in claim 1 wherein the sound absorbing device is mounted in both upstream and downstream compartments.

6. The assembly defined in claim 1 wherein the sound absorbing device is fixedly attached to the inner surface of in said housing.

7. The a assembly defined in claim 1 wherein the sound absorbing device is removably attached to the inner surface of in said housing.

* * * * *